US007152386B2

(12) United States Patent
Brauneis et al.

(10) Patent No.: US 7,152,386 B2
(45) Date of Patent: Dec. 26, 2006

(54) ENVELOPE-FILLING MACHINE

(75) Inventors: Axel Brauneis, Munzenberg Gambach (DE); Eddy Edel, Friedberg (DE); Wolfgang Hartl, Alsfed (DE)

(73) Assignee: Pitney Bowes Deutschland GmbH., Heppenheim (DE)

( * ) Notice: Subject to any disclaimer, the term of this patent is extended or adjusted under 35 U.S.C. 154(b) by 57 days.

(21) Appl. No.: 11/032,041

(22) Filed: Jan. 7, 2005

(65) Prior Publication Data

US 2005/0190184 A1 Sep. 1, 2005

(30) Foreign Application Priority Data

Jan. 8, 2004 (DE) ..... 10 2004 001 360

(51) Int. Cl.
*B65B 43/26* (2006.01)
*B43M 3/04* (2006.01)

(52) U.S. Cl. ..... 53/284.3; 53/381.7; 53/154

(58) Field of Classification Search ..... 53/569, 53/284.3, 252, 381.5–381.7, 154; *B43M 3/00, B43M 3/04*

See application file for complete search history.

(56) References Cited

U.S. PATENT DOCUMENTS 2,325,455 A * 7/1943 Williams ..... 53/284.3
2,657,043 A * 10/1953 Colby ..... 53/154
5,975,514 A * 11/1999 Emigh et al. ..... 53/381.6

FOREIGN PATENT DOCUMENTS

DE 19830337 C1 * 11/1999
EP 945283 A2 * 9/1999

* cited by examiner

*Primary Examiner*—Stephen F. Gerrity
(74) *Attorney, Agent, or Firm*—Michael J. Cummings; Steven J. Shapiro; Angelo N. Chaclas

(57) ABSTRACT

In an envelope-filling machine, a clear and simplified construction of the drive system is achieved for the enclosure-collating path, for the enclosure-feeding stations and for the parts of the envelope-filling station, in that a drive motor and a step-down gear mechanism, a bevel gear mechanism and a step-by-step motion linkage are arranged in a row along a main shaft which extends in the longitudinal direction of the machine and is arranged so as to be offset out of the region below the enclosure cassettes of the enclosure-feeding station, and the main shaft is guided through the step-down gear mechanism and the bevel gear mechanism as far as a coupling point for a crank mechanism in order to actuate a pivoting shaft which is common to the gripper arms of the enclosure-feeding stations.

8 Claims, 4 Drawing Sheets

ENVELOPE-FILLING MACHINE

FIELD OF THE INVENTION

The invention relates to an envelope-filling machine.

The invention relates to an envelope-filling machine having the features of the precharacterizing clause of Patent claim 1.

Envelope-filling machines of this type have been on the market for a considerable length of time.

A drive system for a mail-processing machine having an envelope-filling station, which, however, does not disclose all the features of the envelope-filling machine available on the market, can be gathered from DE 198 30 337 C1.

BACKGROUND OF THE INVENTION

It is a characteristic of envelope-filling machines of this type that some of the assembly parts require a continuous drive or a partially continuous drive which is achieved by controlled clutch actuation, while another part of the assembly parts of a machine of this type require an intermittent drive.

An enclosure-collating path having endless, circulating conveyor belts or chains which are oriented in the longitudinal direction and define enclosure compartments along their upper run between conveying fingers is driven intermittently in that region in which the enclosure-collating path runs past enclosure-feeding stations when the latter are driven synchronously, or is provided with a continuous drive if the enclosure-feeding stations can insert enclosures into the moving enclosure-collating path. In every case, however, an end section of the enclosure-collating path has to move the enclosure conveying compartments forwards intermittently, as a push-in station which is provided at the end of the enclosure-collating path, performs a working stroke in the transverse direction and is intended for inserting a set of enclosures into an envelope requires intermittent conveying of the sets of enclosures. The intermittently driven end section of the enclosure-collating path, which end section adjoins a continuously driven section of the enclosure-collating path, accepts the continuously conveyed sets of enclosures on account of a greater conveying speed and conveys them in front of the push-in station, whose push-in apparatus works synchronously but is actuated by a continuous drive, for example via a crank mechanism. The same applies to gripper arrangements which are provided in the enclosure-feeding stations and are driven synchronously via a common pivoting shaft running in the longitudinal direction of the envelope-filling machine but are in turn actuated from a continuously circulating drive shaft, for example via a crank mechanism.

The envelopes can be conveyed on an envelope-filling table which lies next to and parallel to the enclosure-collating path, initially by means of continuously actuated conveying means, for example conveyor belts moved with their upper run approximately at the level of the envelope-filling table, as far as the push-in station. If an envelope has been filled with a set of enclosures, a synchronously driven conveyor chain then grips the filled envelope or item of mail, pulls the item of mail out of the region in front of the push-in station, pulls it through an envelope-closing path and finally feeds it to an apparatus for further conveying or pulls it into an envelope-turning station which turns over the filled envelope so that its address side or envelope window side lies on top and subsequently feeds it to an apparatus for further conveying. The turning station is driven synchronously, which happens by coupling it to a continuous drive in a time-controlled manner.

The drive system of the known mail-processing machines or envelope-filling machines comprises, below the level of the enclosure-collating path, the base plate of the push-in station and the surface of the envelope-filling table, an electric drive motor in a framework and a step-down gear mechanism attached to the said drive motor, which is, however, not shown in the above-mentioned DE 198 30 337 C1. Furthermore, the drive system of the known machines comprises a bevel gear mechanism and a step-by-step motion linkage which is coupled to the said bevel gear mechanism. This drive system thus provides output shafts which cause shafts which extend in the longitudinal direction of the machine, that is to say parallel to the longitudinal orientation of the enclosure-collating path, to rotate continuously, these shafts making the actuation movements possible which proceed in a transverse direction with respect to the longitudinal direction of the machine, via crank mechanisms or eccentric drives. Furthermore, the drive system provides continuously rotating output shafts which are oriented in the transverse direction and make it possible to drive shafts which extend in the transverse direction and are coupled to enclosure-conveying means or to envelope-conveying means, as long as the latter are to be driven continuously, and furthermore provides output shafts of the step-by-step motion linkage which are coupled to shafts which require intermittent enclosure conveying or intermittent envelope conveying.

It has been shown then that, in the known mail-processing machines or envelope-filling machines of the above-discussed type, the arrangement of the various drive members, transmission shafts and drive shafts below the level of the enclosure-collating path, the envelope-filling table and, in particular, below the enclosure-feeding stations, takes up a considerable amount of space, is very complicated and prevents defined sensor devices from being attached below the enclosure-feeding stations.

SUMMARY OF THE INVENTION

It is accordingly an object of the invention to configure an envelope-filling machine in such a way that the drive system is less complicated, has a smaller number of transmission shafts and bearing points, can be manufactured more economically and can be arranged in such regions below the enclosure-collating path, the envelope-filling table and the enclosure-feeding stations that additional space is available for attaching sensor devices.

Advantageous refinements and developments are the subject matter of the subordinate patent claims to claim 1, the content of which is expressly made a constituent part of the description as a result of this, without repeating the wording at this point.

DESCRIPTION OF THE DRAWINGS

In the following text, a preferred embodiment will be explained using the drawing, in which.

DETAILED DESCRIPTION

Figure 1:
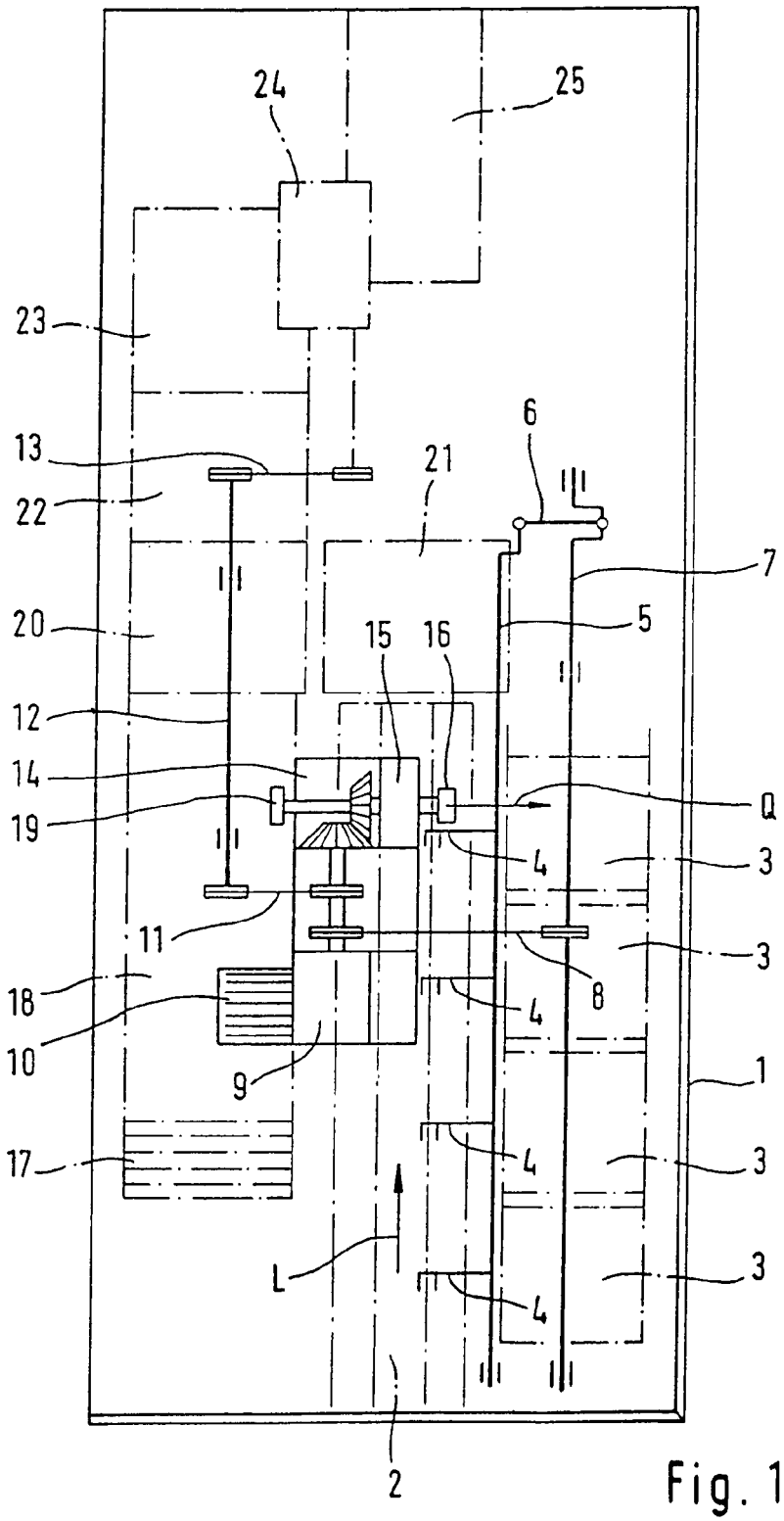
Fig. 1 ( PRIOR ART )
FIG. 1 shows a diagrammatic plan view of an envelope-filling machine according to the prior art.

An envelope-filling machine of the conventional type comprises, supported on a framework indicated diagrammatically at 1, an enclosure-collating path 2 which has conveyor belts or conveyor chains which are guided over rollers or sprockets, circulate endlessly and define enclosure-conveying compartments in the region of their upper run between conveying fingers. Enclosure-feeding stations 3 are arranged in a row in the longitudinal direction corresponding to the arrow L along the enclosure-collating path 2, of which enclosure-feeding stations 3 at least some comprise enclosure cassettes in the manner known to those skilled in the art, into which enclosure cassettes enclosure stacks are inserted which lie exposed via openings at the lower end of the enclosure cassettes facing the enclosure-collating path 2, in such a way that, from the lower end of the enclosure stack, a respective lowermost enclosure can be lifted off by a pivotable suction-cup arrangement, held separate from the enclosure stack by separating fingers which can be pivoted against the lower end of the enclosure stack, and then gripped by the carriers of gripper arms 4 which are connected fixedly to a pivoting shaft 5 on a level above the upper side of the enclosure-collating path 2, the gripper carriers gripping the lowermost enclosure of the enclosure stack in the enclosure cassettes of the enclosure-feeding stations 3 in a manner known to those skilled in the art, and inserting it in a pivoting movement in each case into an enclosure-conveying compartment of the enclosure-collating path 2, after which the conveying compartments of the enclosure-collating path 2 are moved further in the direction of the longitudinal direction L about a conveying compartment pitch.

The pivoting shaft 5 is driven via a crank mechanism 6 from a main shaft 7 which extends parallel to the longitudinal direction L. In known machines, this main shaft 7 lies below the level of the enclosure-collating path 2 and below the floors of the enclosure cassettes of the enclosure-feeding stations 3.

The main shaft 7 is set in rotation by the output shaft of a step-down worm gear mechanism 9 via a chain drive 8, which step-down worm gear mechanism 9 is attached to an electric drive motor 10. A further chain drive 11 transmits drive energy from the output of the step-down worm gear mechanism 9 to an auxiliary shaft 12 which transmits drive to a further consumer via a third chain drive 13, which will be explained in greater detail in the following text.

Finally, a bevel gear mechanism 14 is coupled to the output shaft of the step-down worm gear mechanism 9, and a step-by-step motion linkage 15 whose output shaft 16 is oriented in the transverse direction corresponding to the arrow Q is coupled to the said bevel gear mechanism 14.

It goes without saying that, with the exception of the pivoting shaft 5 and the gripper arms 4 attached to the latter, the described parts of the drive system, namely the main shaft 7, the chain drives 8, 11 and 13, the electric drive motor 10, the step-down worm gear mechanism 9, the bevel gear mechanism 14 and the step-by-step motion linkage 15 as well as the auxiliary shaft 12, are situated below the level of the enclosure-collating path 2.

Moreover, FIG. 1 shows, in a manner indicated by a dash-dotted line, an envelope supply 17, an envelope-supplying apparatus 18 which adjoins the latter and whose conveyor belts which extend parallel to the longitudinal direction require, for example, a continuous drive which can be tapped off from a drive 19 of the bevel gear mechanism 14; furthermore, FIG. 1 shows an envelope-positioning station 20 which lies in front of a push-in station 21. The push-in station 21 comprises a push-in apparatus for removing sets of enclosures from the enclosure-collating path 2 and for inserting the sets of enclosures into the envelopes which are held open in the envelope-positioning station 20. The push-in apparatus of the push-in station 21 requires a synchronous drive in order to perform the work stroke parallel to the transverse direction Q, this drive movement being diverted from the continuously driven main shaft 7 by a crank mechanism or eccentric drive. Details with respect to this are not shown in FIG. 1 in order to simplify the illustration, but are known to those skilled in the art.

After the envelope has been filled in the station 20, the item of mail is gripped by an intermittently driven gripper chain, guided through a closing section 22 and finally pulled into a turning station 23. The intermittently driven gripper chain requires an intermittent drive which is diverted from the output 16 of the step-by-step motion linkage 15. Situated in the turning station 23 is a turning cylinder 24 having cam-controlled gripper tongs which are arranged along generating lines of its circumference and each grip a filled envelope which is conveyed next to the turning cylinder at the edge of the said envelope which is close to the rotational axis of the turning cylinder and then, while rotating the turning cylinder, deposit it in the delivery station 25 with the address side or the envelope window side lying on top. The turning cylinder 24 is driven by the auxiliary shaft 12 via the chain drive 13 and by the continuously circulating output shaft of the step-down worm gear mechanism 9 via a clutch which can be switched on and off selectively.

The synchronized drive of the enclosure-collating path 2 is performed from the output 16 of the step-by-step motion linkage, in the same way as the synchronized drive of the abovementioned gripper-carrier chain of the envelope-filling table. Drive connections with regard to this are likewise omitted in FIG. 1 in order to simplify the illustration.

It can be seen in FIG. 1 that the main shaft 7 of the known construction of an envelope-filling machine is guided through below the enclosure-feeding stations and restricts the space for sensors or cameras which are to be attached below the enclosure cassettes for reading information from the underside of the respectively lowermost enclosure. The additional shaft 12 must be provided in order to supply continuous or controllably continuous drive energy to consumers on that side of the enclosure-collating path 2 which lies opposite the enclosure-feeding stations 3.

Figure 2:
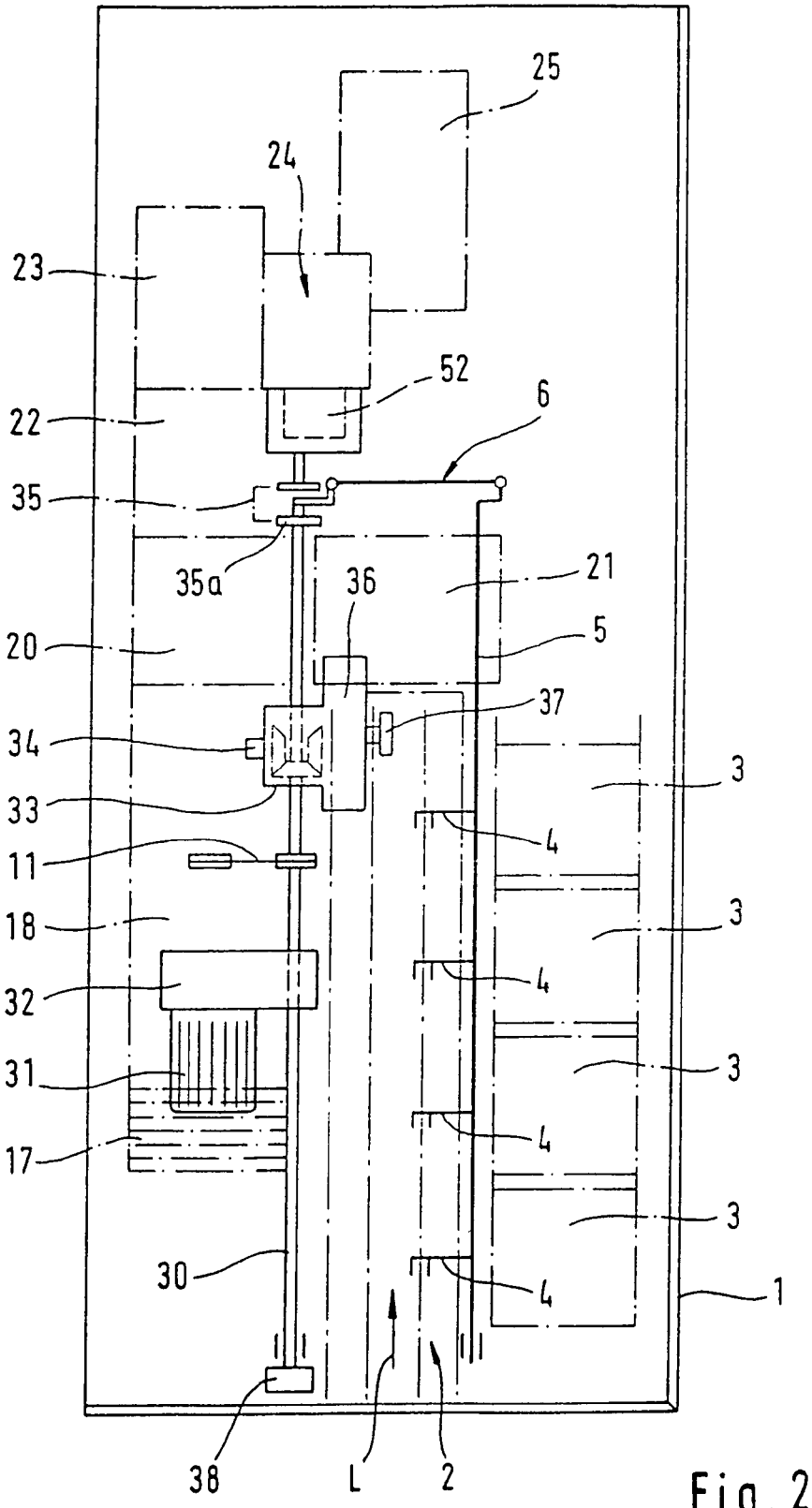
FIG. 2 shows a similar illustration to FIG. 1 of an envelope-filling machine of the type proposed here.

In the very diagrammatic plan view illustration shown in FIG. 2, an envelope-filling machine of the type specified here is shown, identical reference numerals being used in FIG. 2 for assembly parts which substantially correspond to those according to FIG. 1, and another detailed description also being omitted if the functions correspond to one another.

It can be seen that, in the envelope-filling machine according to FIG. 2, in order to actuate the pivoting shaft 5 which is multiply mounted above the level of the enclosure-collating path 2, bears the gripper arms 4 and serves to pivot the latter, the crank mechanism 6 is guided in the enclosure-conveying direction in front of the push-in station 21 to a main shaft 30 which extends over a substantial length of the envelope-filling machine and does not extend below the enclosure-feeding stations 3 but is situated below the enclosure-collating path 2 and the envelope-supplying apparatus 18. An electric drive motor 31, whose shaft is oriented parallel to the longitudinal direction L, drives the main shaft 30 which is guided through the gear mechanism 32 via a flat spur gear mechanism 32. The main shaft 30 then reaches a bevel gear mechanism and is guided through the said bevel gear mechanism. The bevel gear mechanism 33 can have an output shaft 34 for supplying continuous drive energy with a rotational axis which is oriented transversely with respect to the longitudinal direction L. Finally, the main shaft 30 reaches a chain drive 35 for the controlled, continuous movement of the turning cylinder 24 of the turning station 23 in the manner described previously in conjunction with the known device according to FIG. 1, and subsequently a crank of the crank mechanism 6 for driving the pivoting shaft 5.

A step-by-step motion linkage 36 is coupled to the bevel gear mechanism 32, it being possible to tap off intermittent rotational movements from the output shaft 37 of the said step-by-step motion linkage 36, as they are required for driving gripper chains, for conveying envelopes over the envelope-filling table and in the downstream section of the envelope-filling table, and for driving the conveyor belts or conveyor chains of the enclosure-collating path.

In a manner which is not shown, the push-in apparatus of the push-in station 21 receives the drive energy from the main shaft 30 or else, preferably, from a link fastened directly to the pivoting shaft 5, either via a crank or an eccentric drive.

38 indicates eccentric drives or crank mechanisms which are symbolically coupled directly to the main shaft 30 and are coupled via associated crank rods to pivoting shafts which extend parallel to the enclosure-collating path 2, serve to actuate the suction-cup arrangement and separating-finger arrangements at the lower end of the enclosure cassettes of the enclosure-feeding stations 3, and can also actuate synchronously actuated hold-down members along the enclosure-collating path 2.

Drive functions can be fulfilled on the envelope-filling table, in the region of an envelope feeder and the like, via the chain drive 11 which is likewise indicated in FIG. 2.

The simplification of the entire drive system can be seen clearly in FIG. 2, in that the main shaft 30 is guided through a spur gear mechanism and a bevel gear mechanism to the crank of the crank mechanism 6 and can finally also be used directly to drive the turning cylinder 24. The chain drive 35 situated near the front end of the main shaft 30 is provided for the last purpose, the drive sprocket 35*a* of the said chain drive 35 being fastened directly to the main shaft 30 behind the crank of the crank mechanism 6 for driving the pivoting shaft 5.

Figure 3:
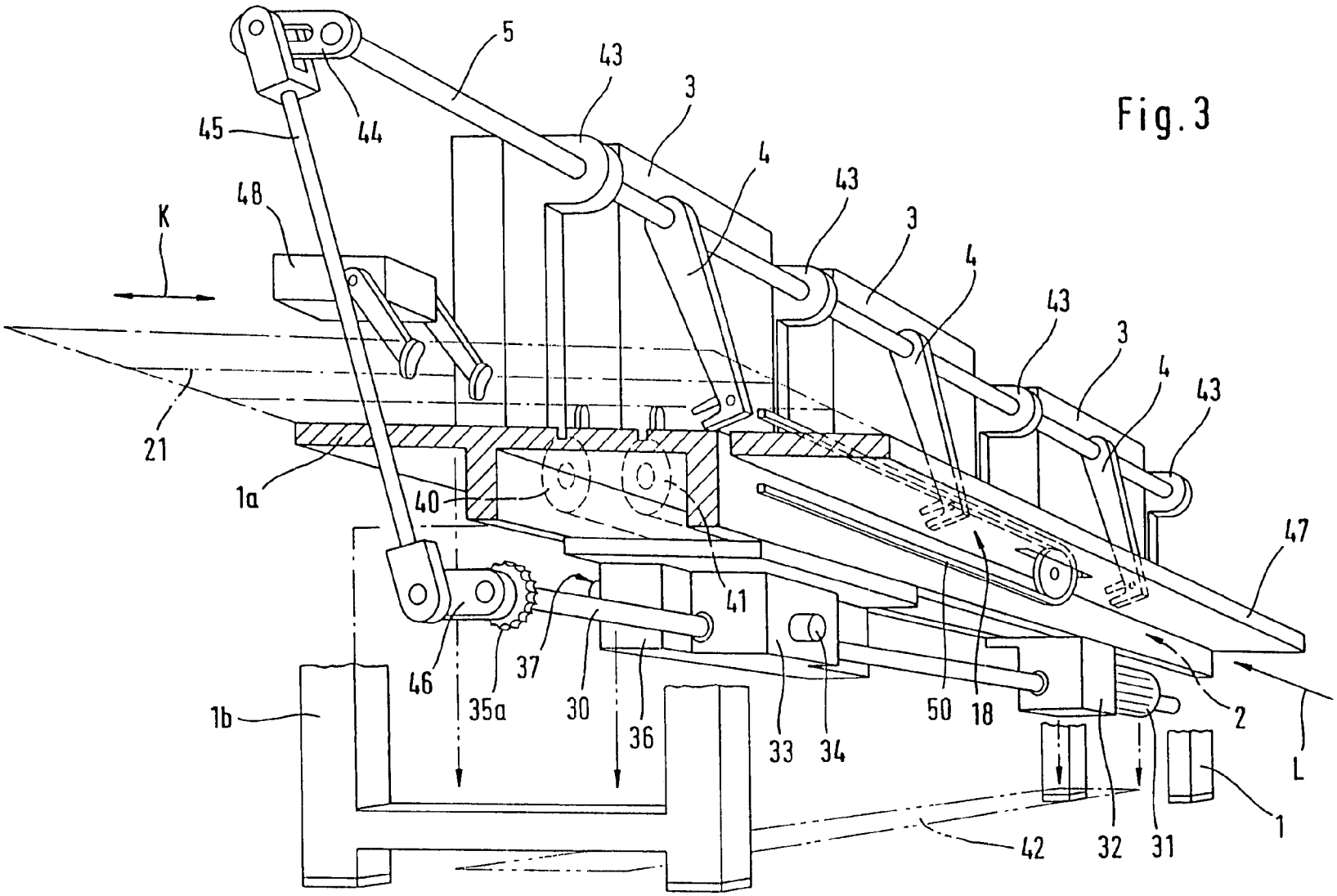
FIG. 3 shows a diagrammatic, perspective illustration of the rear part (with regard to the conveying direction of the enclosures) of an envelope-filling machine of the type specified here, from a viewing direction obliquely from below in the direction of the start of the enclosure-collating path.
Figure 4:
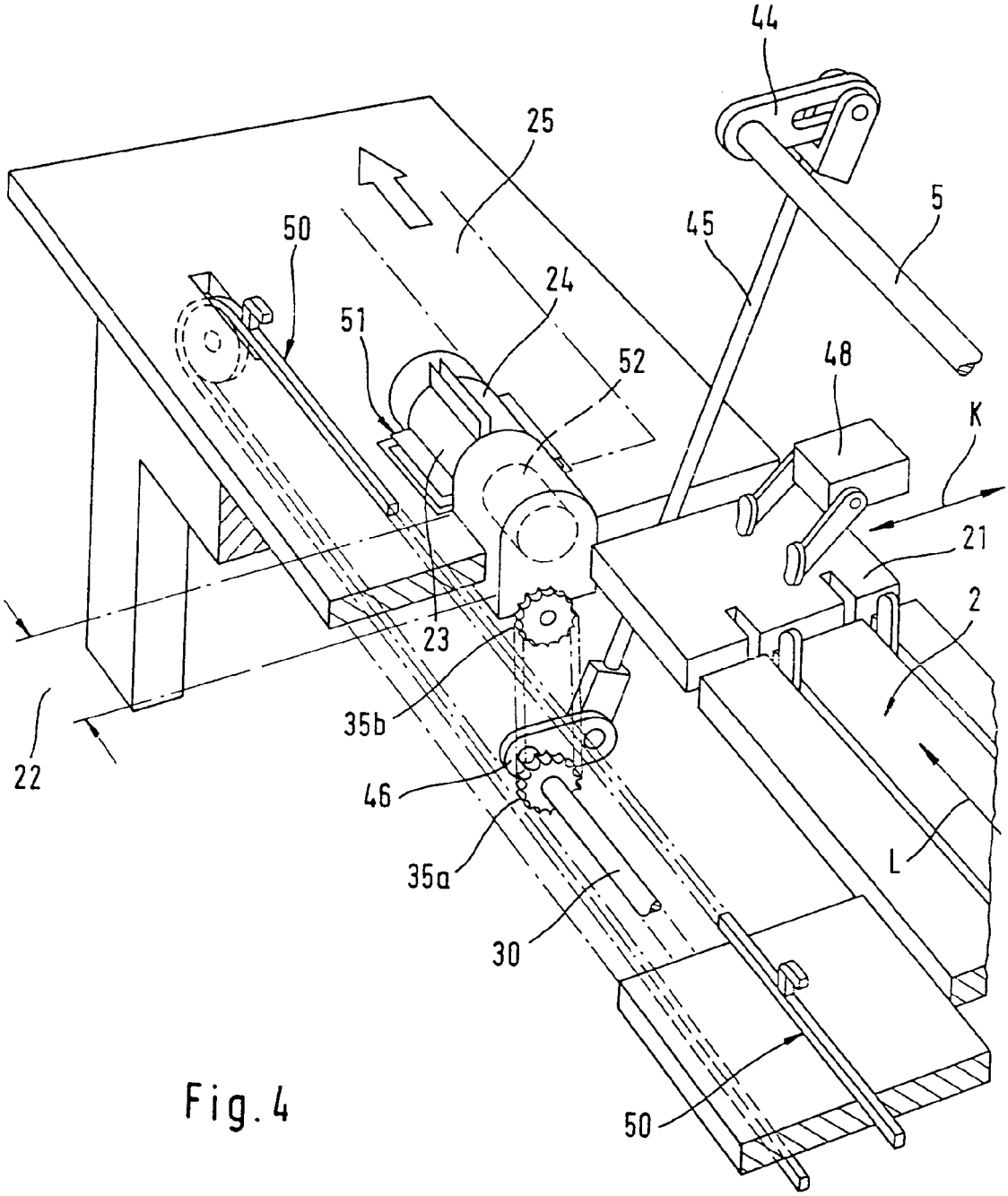
FIG. 4 shows a diagrammatic, perspective illustration of the enclosure-collating path according to FIG. 3, with a viewing direction obliquely from above in the direction of the front end (with regard to the conveying direction of the item of mail) of the machine.

The spatial arrangement of the assembly parts of the envelope-filling machine specified here can be seen in FIGS. 3 and 4. Assembly parts which correspond to those in FIGS. 1 and 2 are also provided in each case with identical reference numerals in FIGS. 3 and 4.

Sprockets 40 and 41 serve to drive endless, circulating conveyor chains which are equipped with conveying fingers, form the enclosure-collating path 2 with their upper run and bring about synchronous conveying of enclosure-conveying compartments defined between the conveying fingers and sets of enclosures ultimately placed in the latter in the direction of the arrow L, by being coupled to an intermittent drive, in the present case to the output 37 of the step-by-step motion linkage 36.

The enclosure-feeding stations 3 are arranged in a row next to the enclosure-collating path 2, at least some of the said enclosure-feeding stations 3 comprising enclosure cassettes, as shown in FIGS. 2 and 3. Sheet-feeding stations can also be connected in between which provide individual enclosures for delivery to the enclosure-collating path from enclosure-supplying apparatuses which are oriented transversely with respect to the direction in accordance with the arrow L, which is not shown in the drawing, however.

The vertical projection below the enclosure cassettes of the enclosure-feeding stations 3 is indicated in FIG. 3 by double dash-dotted lines at 42. As has already been mentioned, this region below the floors of the cassettes of the enclosure-feeding stations 3 is kept substantially free from drive shafts and drive members of the envelope-filling machine.

Situated in the region between the cassettes of the enclosure-feeding stations 3 are bearing supports 43 for bearing the pivoting shaft 5 which passes through and to which gripper arms 4 are fastened in the manner shown. As has already been mentioned, the gripper arms 4 serve to pull off the respectively lowermost enclosure of the enclosure stack situated in the enclosure cassettes of the enclosure-feeding stations 3, in order to insert it into the enclosure-conveying compartments of the enclosure-collating path 2 in the way which is familiar to those skilled in the art. The gripper carriers at the lower gripper-arm end can be controlled into the open position and closed position electromagnetically or via an actuating shaft which is common to the gripper arms and slotted guide arrangements interacting with the latter or the like in a manner which is familiar to those skilled in the art.

The push-in station 21 which is indicated in FIG. 3 by a dash-dotted line and with its base plate seen from below lies in front of the enclosure-collating path 2 in the direction of the arrow L or in the conveying direction of the sets of enclosures which are to be placed in envelopes. The pivoting shaft 5 is extended beyond the push-in station 21 at its level above the sheet-collating path 2 and bears at its end a link 44 whose free end is coupled to a crank 46 of the main shaft 30 via a crank rod 45, the link 44, the crank rod 45 and the crank 46 forming the crank mechanism which is denoted by 6 in FIG. 2.

It can be seen from FIG. 3 that the crank rod 45 reaches down from the link 44 through the level of the enclosure-collating path 2 and the envelope-filling table attached laterally to the latter (denoted by 47 in FIG. 3) to the crank 46 of the main shaft 30 at that location where no passage has to be kept free for enclosures or sets of enclosures or for envelopes. In the present case, this is the region in the enclosure-conveying direction in front of the push-in station 21 which extends over the width of the enclosure-collating path 2.

According to an embodiment which is not shown, the push-in apparatus 48 can be coupled to the main shaft 30 via a crank mechanism or an eccentric drive in order to perform the working stroke and return stroke extending in the direction of the double arrow K. However, a carrier of the push-in apparatus 48 which is provided with push-in arms is preferably coupled, for example, to a link which is fastened to the pivoting shaft 5, details with respect to this being omitted in FIG. 3 in order to simplify the illustration.

The envelope-supplying apparatus 18 is situated next to the enclosure-collating path 2 and at substantially the same level, and, together with the mail-delivery apparatus shown in FIG. 4, is formed by a single machine component which has the form of a circulating gripper chain 50 in the embodiment shown, which gripper chain 50 extends parallel to the enclosure-collating path and next to the latter from the region in front of the push-in station 21 into a region behind the turning station 23. The gripper chain 50 is fitted with gripper carriers which protrude in the region of the upper run of the gripper chain 50 beyond the level of the envelope-filling table, the base plate of the push-in station and the level of the working surface of the turning station and which can be actuated along their path in a controlled manner into the open position, the closed position, the open position, etc. by slotted guides (not shown in the drawing) in a manner which is known to those skilled in the art, and which can be stopped in defined positions along their path by appropriate synchronous driving of the sprockets over which the gripper chain 50 is placed, for instance by clutch actuation.

In detail, an envelope is inserted from the lower end of an envelope stack by a suitable actuating apparatus into a gripper carrier which has been stopped in the open position near the start (indicated diagrammatically in FIG. 3) of the gripper chain 50. Afterwards, the gripper carrier is moved into the closed position and the gripper chain is set in motion, with the result that the envelope is pulled in front of the push-in station 21 by the gripper chain by means of the closed gripper carrier. Here, the gripper carrier is moved into the open position, in order for it to be possible to push a set of enclosures into the envelope in an unimpeded manner by means of the push-in apparatus 48. Subsequently, the relevant gripper carrier is moved into the closed position again and the gripper chain is set in motion again, in order to pull the filled envelope, that is to say the item of mail, initially through an envelope-closing path 22 (indicated symbolically in FIG. 4) and then into the turning station 23, after which the gripper chain is stopped again, the relevant gripper carrier is moved into the open position and then moved further by starting up the gripper chain again, in order to release the item of mail in the turning station.

The synchronously driven gripper chain 50 can be driven by the continuously circulating output 34 of the bevel gear mechanism 33 via a controllable clutch, details with respect to this being omitted in order to simplify the illustration.

It can be seen in FIG. 3 that, from the intermittently circulating outputs 37 of the step-by-step motion linkage 36, the drive connection to the sprockets 40 and 41 of the enclosure-collating path can be guided in regions which are not located in the vertical projection region below the enclosure cassettes of the enclosure-feeding stations 3, which contributes to the simplification of the overall construction and to the simplification of the drive system and has the substantial advantage that sensors and cameras for sensing marks or reading information on the respective enclosure undersides via cut-outs in the enclosure cassettes can be mounted below the floors of the enclosure cassettes.

The further path of sets of enclosures inserted into envelopes, that is to say the items of mail, in the envelope-filling machine of the type specified here is explained using FIG. 4. Respectively identical reference numerals are used once again in FIG. 4 for parts which correspond to those in FIG. 3.

When the closed envelope which contains the set of enclosures has reached the turning station 23, the edge of the envelope which extends parallel to the direction L and is adjacent to the turning cylinder 24 passes between the bar-like pairs of tongs 51 of the turning cylinder 24 which are situated in the open position and extend along generating lines of the turning cylinder 24, the pairs of tongs moving, during the revolution with the turning cylinder 24 in a manner controlled by cam discs, from the open position, which they have when the opening of the tongs is positioned in the plane of the turning station 23, into the closed position during the rotation on the circumference of the turning cylinder 24, in order then to pass again into the open position, when their opening of the tongs is again situated in the plane of the turning station 23 after a revolution of 180°, in such a way that an envelope which has been turned by the tongs of the turning cylinder 24 is placed onto the surface of the turning station with the address side or the envelope window side pointing upwards, the envelope can be conveyed away by further conveying apparatuses 25 which are shown symbolically in FIG. 4.

It can be seen from FIG. 4 that the turning cylinder 24 is coupled to the chain drive or toothed-belt drive 35 via a clutch 52 which can be engaged and disengaged selectively, in such a way that the turning cylinder 24 can be driven directly from the main shaft 30, as shown in FIG. 4. For this purpose, a sprocket 35*a* of the chain drive 35 is seated on the main shaft 30 directly behind the crank 46, and a sprocket 35*b* of the chain drive is provided at the rear end of the turning station which is mounted in a stationary manner on the framework 1 or on the head part 1*a*.

It can be seen from FIG. 3 that, according to a very advantageous embodiment of the envelope-filling machine specified here, the framework 1 is of two-part design, namely comprises a head part 1*a* which can be handled separately, can be placed on a lower frame 1*b* and can be fastened to the latter. The head part 1*a* comprises a downwardly open carrier which extends substantially over the entire length of the enclosure-collating path 2 and the push-in station 21, is U-shaped in cross section and to whose lateral limbs both the step-down gear mechanism 32 with the electric drive motor 31 fastened to it and the bevel gear mechanism 33 and the step-by-step motion linkage 36 are fastened, as shown diagrammatically in FIG. 3. The lateral limbs of the longitudinal carrier of U-shaped cross section also serve to mount the sprockets or rollers of the circulating chains or belts of the enclosure-collating path which extends on the upper side of the horizontal web of the abovementioned carrier. The result is thus that the entire drive system, while avoiding circulating auxiliary shafts, is concentrated substantially on the continuous main shaft 30 which is passed through the step-down gear mechanism, the bevel gear mechanism and the step-by-step motion linkage, all the gear mechanisms being fastened, together with the drive motor, to the head part and it being possible to handle this machine component as one structural unit.

The invention claimed is:

1. Envelope-filling machine, having the following assembly parts:

a) a framework which extends parallel to an enclosure-conveying direction;

b) an enclosure-collating path which is installed on the framework and having conveyors on which enclosure-conveying compartments are formed which can be moved intermittently in the enclosure-conveying direction;

c) an envelope-filling station which is arranged on the framework at the end of the enclosure-collating path and, using a push-in apparatus, pushes sets of enclosures in the transverse direction onto an envelope-filling table which lies in front of the push-in station and next to the enclosure-collating path;

d) an envelope-supplying apparatus which conveys open envelopes in a synchronized manner and parallel with respect to the conveying direction of the enclosure-collating path in front of the push-in station and prepares them to be filled with a set of enclosures;

e) a synchronously driven mail-removal apparatus which adjoins the envelope-supplying apparatus in its conveying direction;

f) enclosure-feeding stations which have gripper arms for removing enclosures from the underside of enclosure stacks provided in enclosure cassettes and for inserting them into the enclosure compartments, which gripper arms can be actuated synchronously in each case and are arranged in rows on the framework next to the enclosure-collating path; and g) a drive system for the assembly parts b) to f), which drive system comprises, below the level of the enclosure-collating path, a drive motor, a step-down gear mechanism connected to the drive motor, and, coupled to the said gear mechanism, a bevel gear mechanism and a step-by-step motion linkage, the output of the step-down gear mechanism being oriented in parallel with respect to the framework and serving to drive a main shaft which actuates, via a crank mechanism, a pivoting shaft which is common to the gripper arms of the enclosure-feeding stations, while the output of the bevel gear mechanism is oriented in the abovementioned transverse direction and serves to drive those assembly parts b) to f) which are actuated continuously and in a controlled manner, and the output of the step-by-step motion linkage is likewise oriented in the abovementioned transverse direction and serves to drive those assembly parts b) to f) which are driven intermittently;

wherein the main shaft extends substantially over the entire length of the enclosure-collating path and of the push-in station and is guided through the step-down gear mechanism and the bevel gear mechanism; and wherein the drive motor having the step-down gear mechanism attached to it, and the bevel gear mechanism and the step-by-step motion linkage are arranged along the main shaft in a row in a region in a perpendicular projection below the enclosure-collating path and/or the envelope-supplying apparatus, in such a way that the region in the perpendicular projection below the enclosure cassettes is kept substantially free from parts of the drive system.

2. Envelope-filling machine according to claim 1, wherein an eccentric drive or crank mechanism which is coupled directly to the main shaft serves to drive the push-in apparatus of the push-in station.

3. Envelope-filling machine according to claim 1, wherein a link which is fastened to the pivoting shaft of the enclosure-feeding apparatus serves to drive the push-in apparatus of the push-in station.

4. Envelope-filling machine according to claim 1, wherein, in the vicinity of the crank mechanism for actuating the pivoting shaft, the main shaft bears a chain sprocket of a chain drive for driving a turning cylinder of a turning station.

5. Envelope-filling machine according to claim 1, wherein a circulating gripper chain which is driven synchronously is provided as the envelope-supplying apparatus and mail-removal apparatus the drive chain sprocket of which is coupled to an intermittently driven output of the step-by-step motion linkage or, via a controllable clutch, to a continuously circulating output of the bevel gear mechanism.

6. Envelope-filling machine according to claim 1, wherein coupling points for crank mechanisms or eccentric drives are provided on the main shaft in a region lying near the start of the enclosure-collating path, from which coupling points it is possible to transmit pivoting movements via coupling rods to suction-cup arrangements and/or separating-finger arrangements and/or hold-down devices of the enclosure-feeding stations or of the enclosure-collating path.

7. Envelope-filling machine according to claim 1, wherein the step-down gear mechanism is a flat spur gear mechanism.

8. Envelope-filling machine according to claim 1, wherein the framework is subdivided into a lower frame and a head part which is fastened to the lower frame and can be removed from the latter, and which has a carrier which extends over the length of the enclosure-collating path and the push-in station and to whose underside the step-down gear mechanism, the bevel gear mechanism and the step-by-step motion linkage are fastened.

* * * * *